United States Patent [19]

Everlith et al.

[11] 4,374,590

[45] Feb. 22, 1983

[54] MASS-PRODUCED MOLDED PLASTIC CESTA

[76] Inventors: Edward A. Everlith, 78 Alcolese Rd.; Jose J. Echaburu, 101 Bassick Rd., both of Trumbull, Conn. 06611

[21] Appl. No.: 319,948

[22] Filed: Oct. 10, 1981

[51] Int. Cl.[3] ..... A63B 59/02

[52] U.S. Cl. ..... 273/326

[58] Field of Search ..... 273/326

[56] References Cited

U.S. PATENT DOCUMENTS

| | | | |
|---|---|---|---|
| 642,638 | 2/1900 | Smith | 273/326 |
| 3,170,688 | 2/1965 | Porter | 273/326 X |
| 4,098,508 | 7/1978 | Gandy | 273/326 |
| 4,273,339 | 6/1981 | Fortunato | 273/326 |
| 4,310,368 | 1/1982 | Urquiaga | 273/326 X |

*Primary Examiner*—William H. Grieb

[57] ABSTRACT

A mass-produced plastic cesta for catching and hurling a hard playing object such as a ball against a playing surface and which is to replace a wicker basket cesta. The cesta is of non-uniform thickness and is made of molded material which has the characteristic wherein hardness is a function of thickness, whereby a relatively rigid handle may be provided in contradistinction to ball catching and launching portions which are less rigid, to assist in catching and holding the ball.

15 Claims, 11 Drawing Figures

22
LP
24
42
R-5
R-4
40
34
R-3
PP
32
R-2
26
42
58
R-1
HP
58
44
28

34
42
42
R-4

34
40
38
42
42
R-3

34
40
38
42
42
R-2

34
36
36
42
42
R-1

MASS-PRODUCED MOLDED PLASTIC CESTA

BACKGROUND OF THE INVENTION

This invention relates to an article for catching and hurling a hard playing object such as a ball against a playing surface, and more particularly, to a plastic cesta which is used with a hard ball called a pelota, in a game called jai alia.

Jai alai is a game in which the ball is rock hard and about the size of a baseball, or about 2½ inches in diameter, weighing approximately 4.5 ounces. Prior cestas have been curved wicker baskets which in effect are an extension of the player's arm. The cestas weigh between 15 and 20 ounces and the frame is made of steam bent chestnut with form-shaping ribs planed down to 1/16th of an inch thick and one inch wide. Reed is woven over the frame and the ribs. A leather glove is sewn to the outside of the cesta and after the player inserts his hand in the glove a cloth tape is wound around the glove to prevent the cesta from slipping free during play.

Wicker cestas take considerable punishment. It is not unusual for a ball to be travelling at a bullet-like speed of approximately 150 miles per hour and the resultant wear and tear on the cesta is readily obvious. It is not believed uncommon for a professional jai alai player to wear out 15 to 20 cestas a year, and most frontons, where the game is played, employ a full time repair man and a full time basket weaver. Attempts have been made to spray a film of plastic on the cesta to prevent the rapid wear and tear on the reeds. This has only been moderately successful.

The growth of jai alai has been inhibited to some extent among amateur jai alai players because of the expense of wicker basket cestas. In some instances cestas run on the order of approximately $200. It has come to the point that amateur jai alai sportsmen eagerly seek to purchase the used cestas cast off by the professional players which are sold at prices substantially less than new cestas.

One of the obvious solutions to the problem of enlarging the amateur jai alai population is to offer them a low cost and mass produced cesta which will closely perform to the professional type wicker basket cesta when used with the game's regulation ball. There have been a number of attempts to mass produce low cost plastic cestas but they have proved unsuccessful. The reasons for the lack of success have been brought about in some measure by the extreme hardness of the ball and the tremendous speeds at which the ball travels. The cesta must be sufficiently resilient or soft to catch the ball without fracturing, and yet it must be sufficiently hard or rigid in order that the player may skillfully manipulate the cesta in a manner to give direction and accuracy to the ball in its flight during play. Some prior cestas have tried to achieve the desired resiliency by making the body of the plastic cesta resilient but then had to utilize stiffners because the cesta in play would tend to twist or warp and otherwise be impractical in play. On the other hand, some plastic cestas were made hard and rigid but then it was found that it was difficult to catch and hold the ball because it would bounce out of the cesta on impact. To correct this problem some cestas would be provided with soft resilient material at those portions which caught the ball but this presented other problems and was not completely satisfactory. Another difficulty with plastic cestas which were too rigid were that they could not withstand the impact of the high velocity ball without fracturing or shattering. Generally, prior art cestas have been made by a vacuum forming process which requires a uniform thickness of the cesta, and this inherently poses difficulty in attaining the performance provided by the wicker basket cesta.

It is an object of the present invention to provide a novel, inexpensive, mass-produced all plastic cesta which closely simulates and approaches the performance of the professional type wicker basket cesta.

It is another object to provide a novel, inexpensive, mass-producing all plastic cesta wherein the ball catching or pocket portion has a flexibility which inhibits bouncing of the ball out of the cesta when caught at high speeds and other portions of the cesta have walls providing rigidity and strength to obviate twisting of the cesta so as to enhance the accuracy of the cesta in play.

A still further object is to provide a novel hand holding means of simple and effective construction for a cesta which effectively secures the player's hand to the cesta handle to greatly improve the accuracy and ease of the use of the cesta in the game of jai alai.

SUMMARY OF THE INVENTION

The present invention contemplates a mass-produced all plastic cesta which has the configuration of a professional wicker basket cesta and closely approximates the weight and performance thereof. The novel cesta has the usual handle portion, pocket portion, and ball launching portion which are molded to non-uniform or varying thicknesses to impart to the respective portions differences in hardness and rigidity. The pocket portion has a recess which together with the launching portion forms a path of travel for delivery of a ball from the cesta. The present invention provides sufficient rigidity to adjacent areas of the cesta to obviate twisting which would occur without such rigidity and this is accomplished by increasing the thickness of the walls forming such portion as they approach a rim of the cesta. The thickness of the wall of the handle portion is significantly greater than that forming the path of travel of the ball because of the necessary strength and rigidity required in that portion of the cesta. The varying thicknesses and surface dimensions of the cesta are carefully calculated, and so integrated, to provide a resulting cesta which has the configuration and contour of the wicker basket cesta and has the same approximate weight of one pound.

The plastic material found to hold up under the rigorous usage demanded of a cesta is a glass reinforced nylon composition and in particular, a modified Nylon 6 material which has glass fibers mixed therein. As may be expected and known the nylon provides a flexibility or softness to the article and the addition of glass fibers imparts a certain hardness. Thus, if the relative portions of the nylon and glass fibers were varied so that a greater amount of nylon were to be used, then the cesta would be too flexible or soft whereby it would twist excessively in play and therefore be unusable. Conversely, if the amount of glass fibers were to be increased to too great a value, the cesta would assume a hardness or brittleness which when impacted by the high speed velocity ball would shatter or fracture. Considerable experimentation has shown that a range of composition of within 88% to 93% Nylon 6 and 7% to 12% glass fibers by weight is effective or desirable overall, but the most preferable composition by weight is 91% Nylon 6 and 9% glass fibers. Departures from such ranges produce the undesirable effects of flexibility and brittleness described above. It also has been found in the molding process that an excess amount of Nylon 6 will cause excessive shrinking so that the cesta cannot hold its dimensions, and undue amounts of glass fibers on the other hand will not cause necessary shrinking required for the molding process.

The present invention also contemplates a novel cesta which includes an adjustable hand holding means in the form of a glove for securely holding the hand of a player. The game of jai alai requires the cesta to be an extension of the arm of the player and therefore loosely fitting gloves will seriously detract from the performance of the player. Simple and effective lacing members are laced through a plurality of web-like pieces of material within the glove to effect the quick and ready tightening of the glove to the hand by exerting a pulling force on one end of the lacing members. The tape has the dual function of effecting the tightening of the glove by exerting a pulling force on the end of the lacing member and also of securing the hand and wrist of a player to a flap end of the glove. In this manner, a firm and secure holding means is accomplished over prior art devices in which the glove was not adjustable and the tape was used merely to prevent the cesta from falling off the hand.

DETAILED DESCRIPTION OF THE INVENTION

Figure 1:
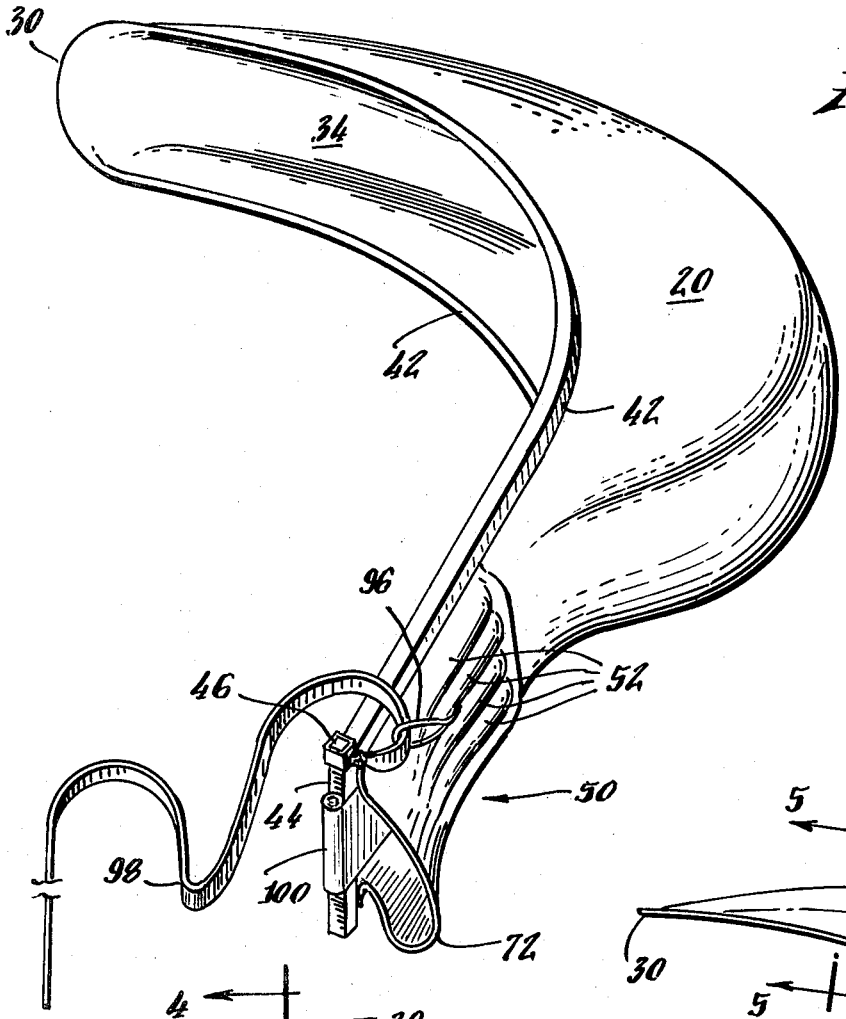
FIG. 1 is a perspective view of the cesta of the present invention.
Figures 4, 5, 6, 7, 8:
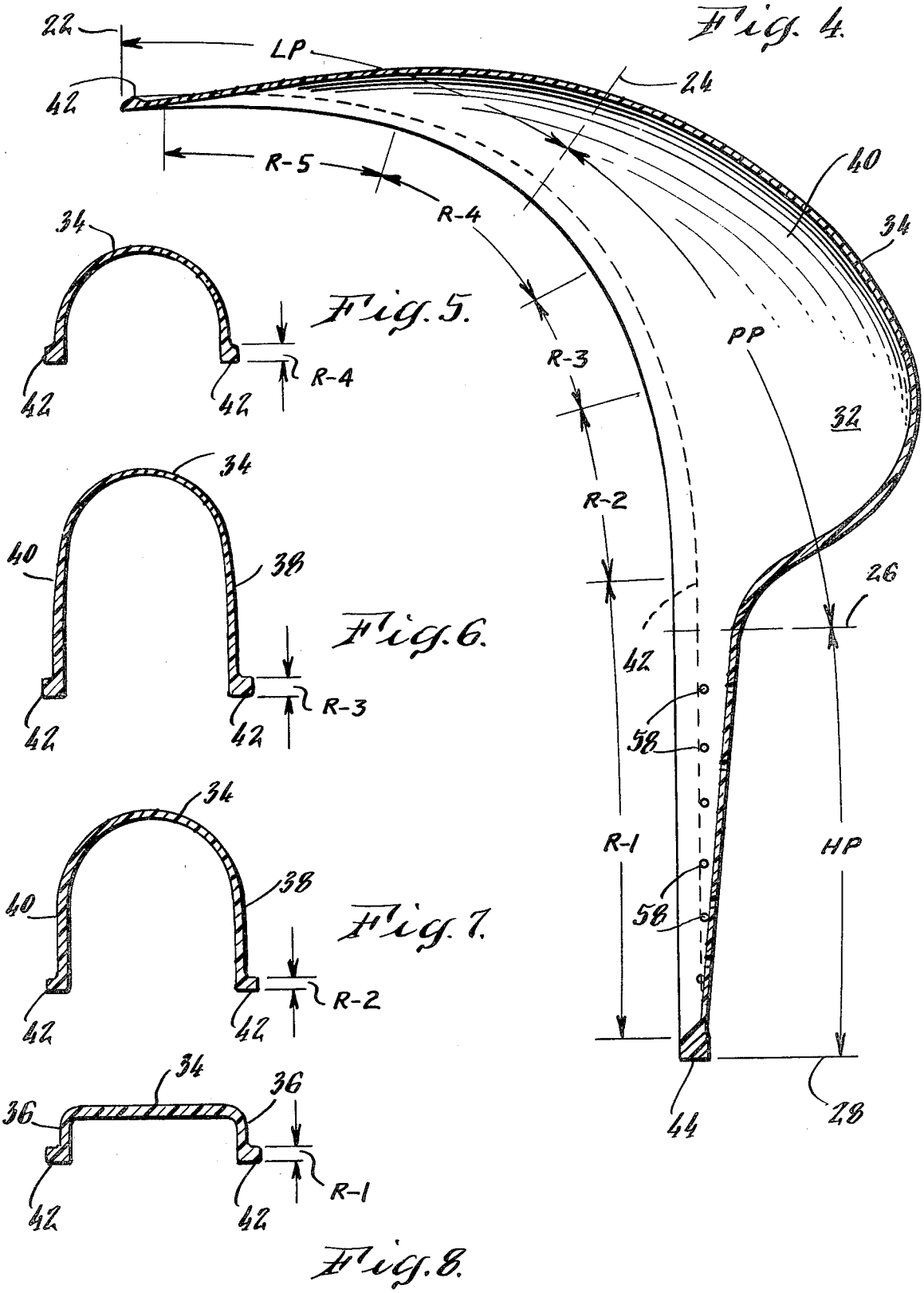
FIG. 4 is a cross-sectional view, in elevation, of the cesta of the present invention but for purposes of clarity has removed therefrom the hand securing means disclosed in the prior figures.
FIG. 5 is a sectional view taken generally on the line 5—5 of FIG. 2.
FIG. 6 is a sectional view taken generally on the line 6—6 of FIG. 2.
FIG. 7 is a sectional view taken generally on the line 7—7 of FIG. 2.
FIG. 8 is a sectional view taken generally on the line 8—8 of FIG. 2.

Referring now to the drawings and more particularly to FIG. 1 hereof, the cesta of the present invention is designated generally as 20, and as better seen in FIG. 4 comprises three portions, a ball launching portion LP the approximate boundries of which are shown as existing between the imaginary lines 22 and 24, a pocket portion PP, the approximate boundaries of which are designated by the imaginary lines 24 and 26, and a handle portion HP lying between boundary lines 26 and 28. The portions LP, PP and HP are contiguous to each other and do not have any clearly delineated boundaries, that is, where one ends off and the other begins, so that the boundaries thereof are approximate and are thus identified in order to more clearly explain the invention. Launching portion LP has a lip or launching tip portion 30 (FIG. 1) from which a ball may be launched, and pocket portion PP has a deep recessed portion 32 (FIG. 4) which serves to catch and hold a ball.

Cesta 20 has a bottom wall 34 which generally extends from handle portion HP at one end to launching tip portion 30 at its other end. Wall 34 generally is arcuate shaped except adjacent the launching tip portion 30 where it flattens out and is substantially flat in handle portion HP where wall 34 is provided with flange portions 36 (FIG. 8). Pocket portion PP may be seen to have a pair of parallel and oppositely disposed walls 38 and 40 which extend transversely from wall 34 (FIG. 6), and such walls extend longitudinally into launching portion LP as well as slightly into handle portion HP. Extending along the rim or edge of cesta 20 is a rib 42 integrally formed with walls 38 and 40 and flange portions 36. Rib 42 is substantially rectangular shaped in cross section along most of the rim of the cesta except along and adjacent launching tip portion 30 where the rib tends to flatten out. A cross bar 44 is disposed at one end of the handle portion HP and has projecting peg portions 46 and 48. The bottom wall 34 which extends from recess 32 to launching tip 30 forms a path of travel for a ball.

Figure 3:
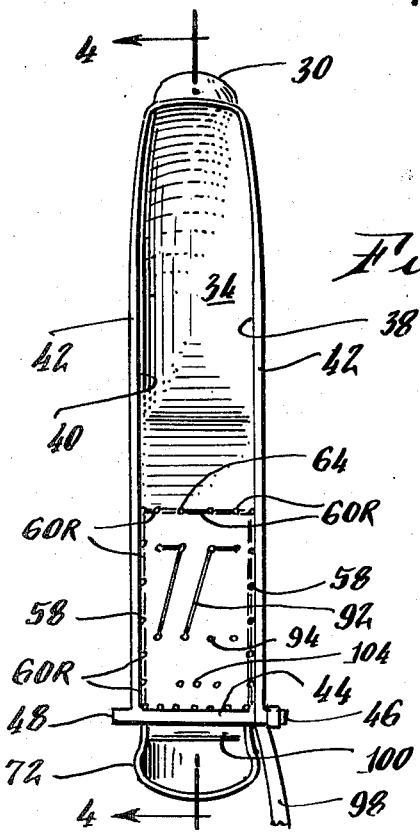
FIG. 3 is a front elevational view of the cesta of FIG. 1, rotated counterclockwise 90° from the position shown in FIG. 2 to more clearly show the interior of the cesta.
Figure 10:
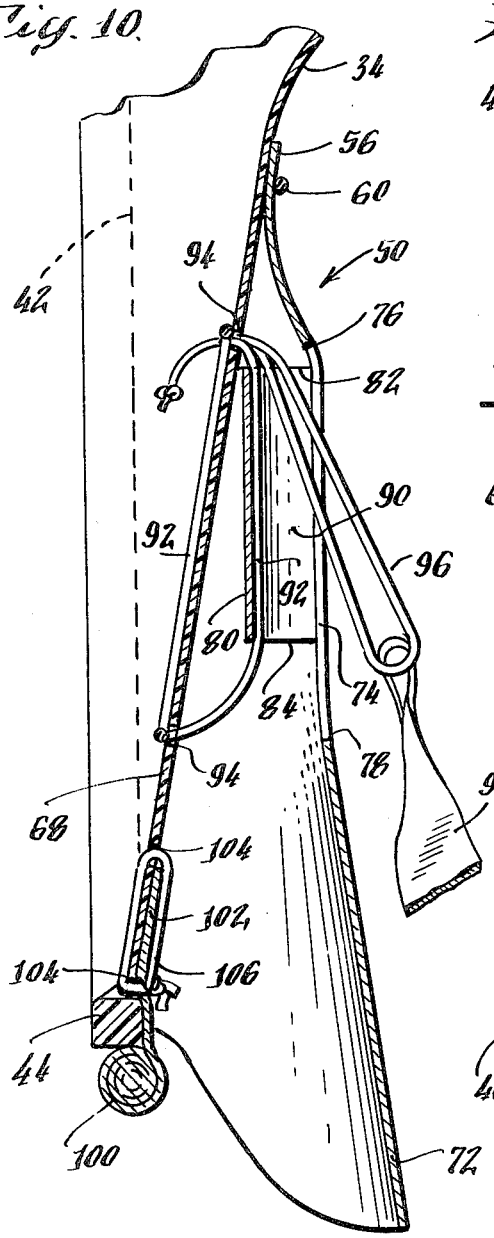
FIG. 10 is a sectional view taken generally along the line 10—10 of FIG. 9; and, FIG. 11 is a sectional view taken generally along the line 11—11 of FIG. 9.
Figure 9:
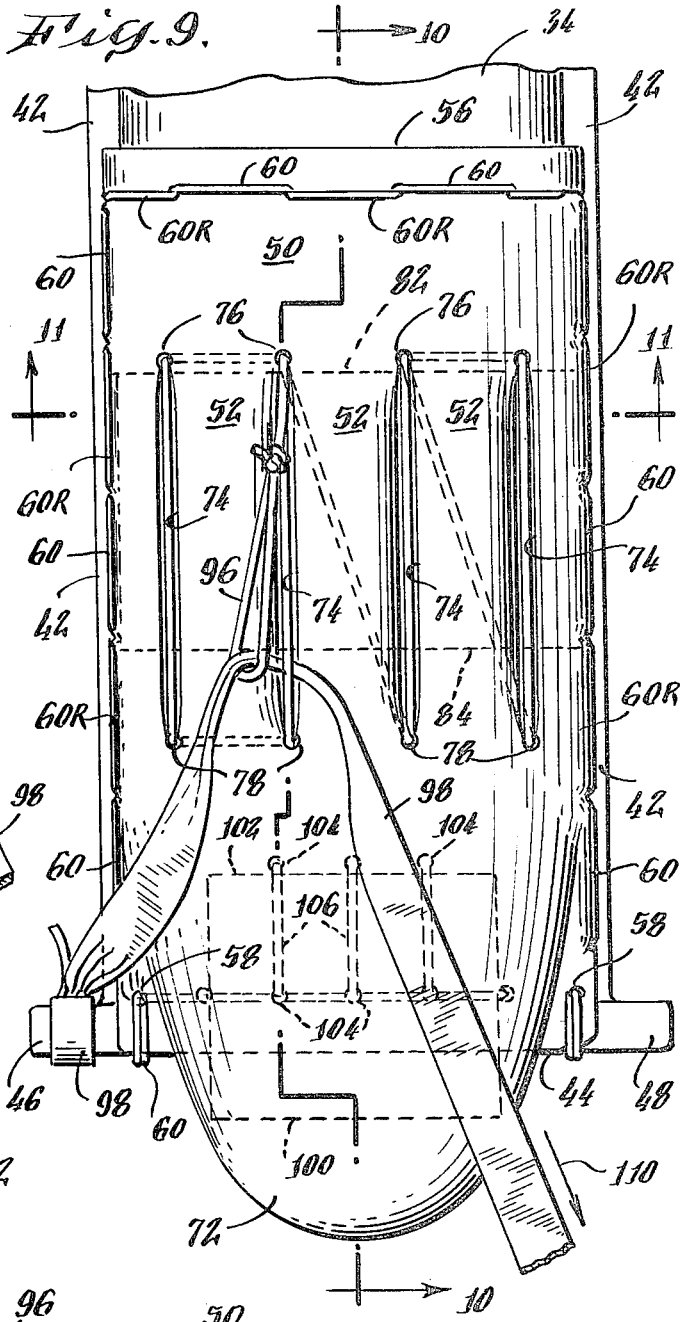
FIG. 9 is a fragmentary and enlarged view of the handle portion of the cesta of FIG. 1 to show in greater detail the construction of the hand securing means.
Figure 11:
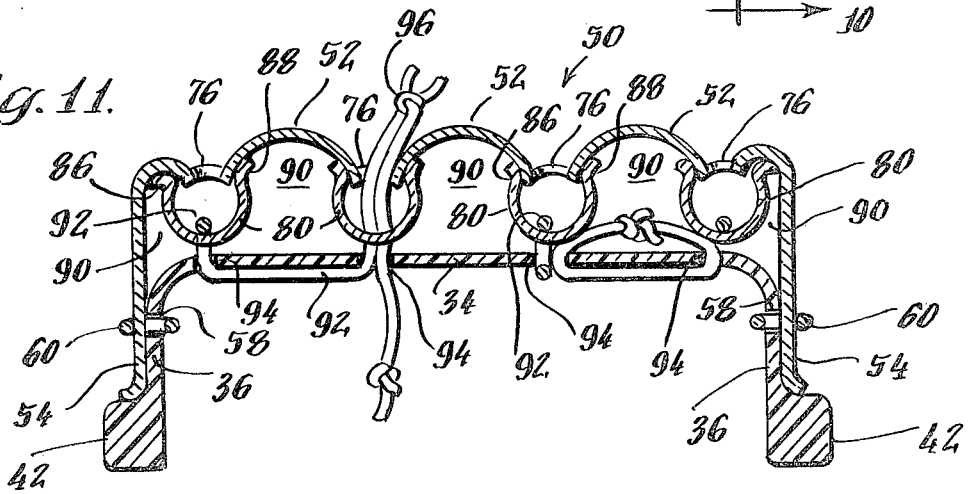

A hand holding means generally designated by the numeral 50 is provided at the handle portion HP and comprises a substantially rectangular sheet of material 52 as for example vinyl or leather, preferably the latter. Sheet 52 has a pair of parallel edges or sides 54 which as best seen in FIG. 11 are arranged to extend along flange portion 36. Sheet 52 has a third edge or side 56 (FIG. 9) which is perpendicularly disposed in respect to sides 54 and extends transversely of the wall 34 in the handle portion HP. Openings 58 are provided in the flanged portion 36 to accommodate a lacing member 60 which is laced through openings 58 and adjacent openings (not shown) formed in sides 54. Lacing member 60 also is laced through openings 64 (FIG. 3) formed in wall 34 and openings (not shown) in side 56 of sheet 50. Lacing member 60 is constructed of one piece having two ends, one of the ends is looped around and secured to peg 46 of cross bar 44 and enters adjacent opening 58, whence it passes under the interior surface 68 (FIG. 10) of wall 34, thence to the next adjacent opening 58 where the lacing member passes through the opening and then goes on to the upper surface of side 54 of sheet 50. Lacing member 60 is continued in this pattern in passing through every opening 58 and alternately appearing below wall 34 on the interior surface 68 as shown in FIGS. 3 and 11, and then on to the upper surface of the sheet 50 as shown in FIGS. 9 and 11. Lacing member 60 then extends along the sides 54 and 56 until the end of lacing member 60 passes through an opening 58 adjacent peg portion 48. At this point the end is then looped again over cross bar 44 and started on its way back through.

From the description to this point, it will be understood that lacing member 60 in proceeding from peg 46 to peg 48 would alternately appear above and below the handle so that the lacing member would only extend or appear between every other pair of openings 58 or 64 above and below the handle. The lacing member is then started back along the path first taken and is again threaded through every opening 58 and 64 so that lacing member in extending initially from peg 46 to peg 48 and then back from peg 48 to peg 46 extends twice through each opening 58 and 64. In order to better and more clearly understand the foregoing, the lacing member 60 is proceeding on its return path from peg 48 to peg 46 is identified by the numeral 60R to distinguish it from those portions which proceed from peg 46 to peg 48. By reason of the foregoing arrangement sheet 50 is securely tied by lacing member 60 to handle LP.

The side of sheet 50 opposite side 56 has a flap portion 72 which is unsecured and spaced free of handle portion HP to form a pocket for a player's hand. Sheet 50 is provided with four parallel and longitudinally extending slits 74 (FIG. 9) having circularly shaped ends 76 and 78. A plurality of rectangularly shaped web-like pieces of material 80 (FIG. 11) are provided immediately below slits 74 and have edges 82 and 84 (FIG. 10) adjacent slits 76 and 78, respectively. Webs 80 are provided with edges 86 and 88 which are stitched to the underside of sheet 50 (FIG. 11) on opposite sides of a slit 74, and thus provide a U-shaped configuration with the bight portion of the web being proximate the exterior surface of wall 34 in handle portion HP. The spaces 90 between and adjacent the webs 80 define finger reception areas for a player's hand. A one piece lacing member 92 is threaded through openings 94 formed in wall 34, and member 90 is laced through each of the looped portions of web 80 to terminate in a knotted loop end 96 clearly shown in FIG. 10. A cloth tape 98 has one end tied to peg portion 46 and as best seen in FIGS. 9 and 10, is adapted to pass through loop 96. A hand supporting roll 100 of flexible material, as for example leather has a portion 102 extending within the pocket formed by sheet 50. Portion 102 has a plurality of openings formed therein which are associated with a plurality of openings 104 formed in wall 34. A lacing member 106 is held in the manner shown in FIG. 9 through openings 104 to securely fasten roll 100 to the handle portion HP.

Figure 2:
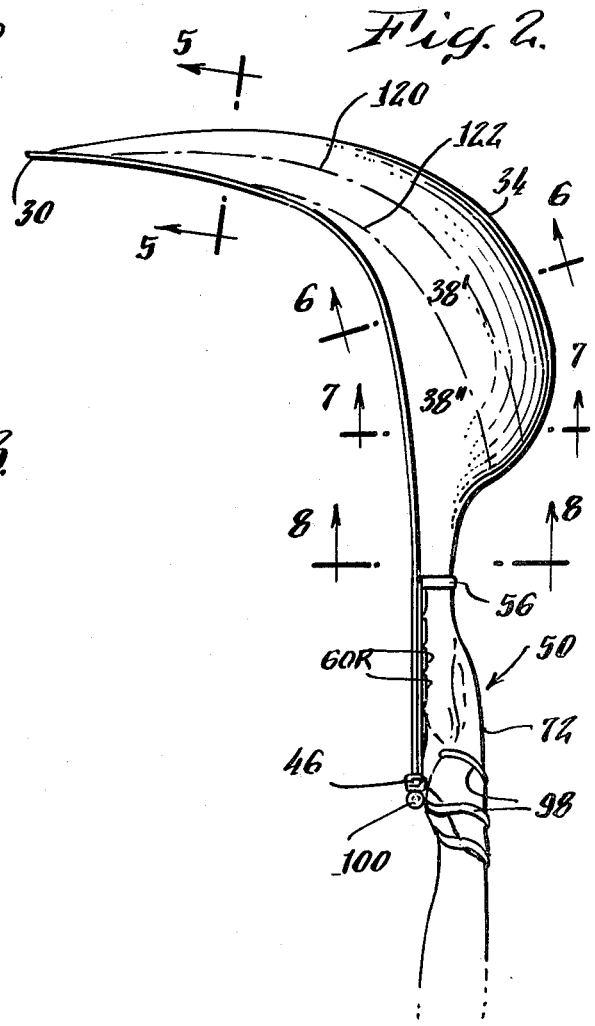
FIG. 2 is a side elevational view of the cesta of FIG. 1 showing the cesta secured to the hand and wrist of a player.

When a player's hand is inserted, as shown in FIG. 2, the fingers of the player are received in spaces 90 and the heel of the player's palm rests on roll 100. With the other hand, the player grips tape 98 to exert a pulling force in the direction of arrow 110 (FIG. 9) and thus on loop 96 to cause the portions of the lacing member 60 (FIG. 11) within the U-shaped portions of web 80 to move the bight portions of the latter toward wall 34. This, in effect, tightens sheet 50 about the finger of a player's hand to firmly secure same to the handle portion HP. The tape is then wrapped around the flap 72 (FIG. 2) to tighten it against the back of the player's hand and wrist.

The cesta when used in a game of jai alai is expected to take a great deal of punishment and consequently it must be strong enough to withstand the hard usage. However, there is also the limitation that it not be in excess of a certain weight if it is to be equivalent to that of a wicker reed basket. When a prior art cesta was made of plastic material, reinforcing strips were used to impart strength or rigidity to the cesta. On the other hand, the present invention contemplates and provides a rigid cesta which comes within the required considerations of a professional wicker reed cesta and yet has the necessary strength and flexibility. This is accomplished by the present invention in the recognition that certain portions of the cesta require rigidity for strength and other portions do not require such strength and may be soft or flexible. This recognition when combined with the concept of providing a material having the characteristic wherein hardness is a function of thickness, provides an inexpensive mass produced cesta of superior quality and performance compared to cestas of the prior art. The present invention contemplates a novel cesta wherein the handle portion is hard or rigid and the pocket portion is less rigid and more flexible or softer.

Cesta 20 is produced by an injection molding process and is constructed of a glass fiber impregnated Nylon 6 composition which has a characteristic wherein hardness is a function of thickness. The composition preferably is in the range of 88% to 93% Nylon 6, and 7% to 12% of glass fibers, by weight, with the most preferable being 91% Nylon 6 and 9% glass fibers by weight. Because the handle portion must have the greatest strength or rigidity, the thickness of wall 34 in handle portion HP is greater than the thickness of the wall in the pocket portion PP, which is much less, approximately half. The reason is that portion of wall 34 must not be so rigid as to cause the ball to bounce out of the recess 32. Parallel walls 38 and 40 are of increasing thickness (FIG. 7) as they progress from wall 34 toward rib 42, because the flexibility required of wall 34 in the recess portion 32 is not required in walls 38 and 40 but rather a certain amount of strengthening is necessary. As indicated hereinabove, wall 34 extends into launching portion LP and is of the same thickness as that existing in pocket portion PP. Rib 42 is required for the greatest structural support for the cesta 20 and accordingly has a far greater thickness than any other walls of the cesta.

In practice, the thickness of wall 34 in the handle portion is 0.090 inches while that portion of wall 34 extending through both pocket portion PP and launching portion LP is approximately 0.045 inches. The thickness of the portion of wall 38 (FIG. 2) adjacent to the wall 34 and within the area indicated by 38' and bounded by broken lines 120 and 122 is approximately 0.065 inches. Area 38" of wall 38 bounded by broken lines 122 and rib 42 is approximately 0.080 inches. Wall 40, not shown in FIG. 2 has wall areas identical to areas 38' and 38" and of various thicknesses, and the values of such thicknesses are identical to that shown for areas 38' and 38". Rib 42 has varying thicknesses along its length and that portion represented by R-1 as seen in FIG. 4 is approximately 0.400 inches, R-2 is approximately 0.500 inches, R-3 is approximately 0.400 inches, R-4 is approximately 0.375 inches, R-5 is approximately 0.325 inches and the flattened portion at launching tip portion 30 is approximately 0.235 inches. It will be understood that the dimensions of the corresponding portions of the rib 42 along both sides of cesta 20 are identical to those disclosed hereinabove.

Although one embodiment of the invention has been described in detail, it is to be expressly understood that the invention is not limited thereto. Various changes can be made in the design and arrangement of parts without departing from the spirit and scope of the invention as the same will now be understood by those skilled in the art.

What is claimed is:

1. A mass-produced hand-held plastic cesta for catching and holding a ball and for discharging a ball therefrom in a controlled directional manner toward a playing surface, comprising;

A. a pocket portion having a recess for catching and holding the ball, said recess having an arcuate shaped bottom wall and a pair of parallel and oppositely disposed walls extending upwardly from said bottom wall;

B. a handle portion at one end of the cesta and contiguous to the pocket portion and having a substantially flat surface;

C. a ball launching portion contiguous with the pocket portion and disposed at the other end of the cesta, said ball launching portion having a substantially arcuate shaped wall contiguous to the pocket portion and being substantially flat at the end thereof to form a ball launching tip from whence the ball is discharged from the cesta, said bottom wall of the recess and said arcuate wall of the launching tip portion defining a path of travel for the ball as it leaves the recess for discharge from the launching tip; and D. a rib formed along the rim of the cesta, said cesta being formed of plastic material having a characteristic wherein hardness is a function of thickness, said walls defining the path of travel of the ball within the cesta being of less thickness than the wall of the handle portion and said rib having a thickness greater than the other portions of the cesta.

2. The cesta of claim 1 wherein the thickness of the walls defining the path of travel of the ball are substantially the same.

3. The cesta of claim 2 wherein the thickness of the walls defining the path of travel of the ball are approximately half the thickness of the wall of the handle portion.

4. The cesta of claim 3 wherein the walls defining the path of travel of the ball is approximately 0.045 inches and that of the handle portion is approximately 0.090 inches.

5. The cesta of claim 2 wherein the parallel walls of the recess are of decreasing thickness in the direction from the rib to the bottom wall.

6. The cesta of claim 5 wherein the thickness of each of the parallel walls consist essentially of two different values, the higher value being adjacent the rib and the lower value being adjacent the bottom wall of the recess.

7. The cesta of claim 6 wherein the higher value is approximately 0.080 inches and the lower value is approximately 0.065 inches.

8. The cesta of claim 1 wherein the material forming the cesta is Nylon 6 impregnated with glass fibers, with the glass fiber imparting hardness characteristics to the Nylon 6 to modify the softness characteristics of the Nylon 6.

9. The cesta of claim 8 wherein the proportion by weight of the glass fiber is in the range of 7% to 12% and the Nylon 6 is in the range of 93% to 77%.

10. The cesta of claim 9 wherein the preferred proportion by weight is 9% glass fibers and 91% Nylon 6.

11. Hand holding means for a cesta having a handle, comprising;

A. a substantially rectangular shaped sheet of flexible material secured to the handle along three sides thereof but open at one side to form a pocket to accomodate a player's hand therein;

B. a plurality of substantially rectangular shaped web-like pieces of material disposed within the pocket at pre-selected portions having two parallel edges secured to the flexible material and two edges unsecured whereby each web-like piece of material takes on the configuration of a U-shaped loop with the bight portion of the loop being proximate the surface of the handle, means formed in the flexible material adjacent each of said web-like pieces of material permitting expansion of the flexible material in directions transverse of the handle; and C. a lacing member having portions extending through the loops of said web-like piece of material and so arranged with respect thereto whereby when one end of the lacing member has exerted thereon a pulling force said portions of the lacing member engage and move each loop toward the handle causing said flexible member to contract and to securely hold a player's hand in said pocket.

12. The hand holding means of claim 11 wherein the expansion permitting means in said flexible material constitute longitudinally extending and parallel slits cut into the flexible material immediately above an associated web-like piece of material.

13. The hand holding means of claim 11 wherein the dimensions of the pocket at said one side are greater than at the secured side of the flexible material to accomodate the positioning of the player's hand therein, and said web-like pieces of material are adapted for positioning between the fingers of a player's hand so as to provide finger reception areas therebetween.

14. The hand holding means of claim 13 wherein said end of the lacing member is formed with a closed loop, projecting pegs are provided at the end of the handle, and a cloth tape having one end secured to a peg with a portion passing through the loop, said tape being adapted for exerting a pulling force on the loop of said lacing member.

15. The hand holding means of claim 14 wherein said one end of the flexible material has an extending flap-like portion adapted to lie over the wrist of the player's hand when it is held to the handle of the cesta.

* * * * *